US006178958B1

(12) United States Patent
Gallops, Jr.

(10) Patent No.: US 6,178,958 B1
(45) Date of Patent: Jan. 30, 2001

(54) ARCHERY BOW HAVING A SIDE MOUNTED SWING ARM CABLE GUARD

(75) Inventor: Henry M. Gallops, Jr., Gainesville, FL (US)

(73) Assignee: Bear Archery, Inc., Gainesville, FL (US)

( * ) Notice: Under 35 U.S.C. 154(b), the term of this patent shall be extended for 0 days.

(21) Appl. No.: 09/368,830

(22) Filed: Aug. 5, 1999

(51) Int. Cl.[7] ..... F41B 5/10
(52) U.S. Cl. ..... 124/25.6
(58) Field of Search ..... 124/25.6, 86, 88

(56) References Cited

U.S. PATENT DOCUMENTS 4,377,152 * 3/1983 Saunders ..... 124/25.6 X
4,452,222 * 6/1984 Quartino et al. ..... 124/25.6 X
4,542,732 * 9/1985 Troncoso ..... 124/25.6
5,161,514 * 11/1992 Cary ..... 124/25.6 X
5,178,122 * 1/1993 Simonds ..... 124/25.6
5,331,941 * 7/1994 Schaffer ..... 124/25.6 X
5,531,211 * 7/1996 Wilfong ..... 124/86
5,651,355 * 7/1997 Gallops ..... 124/25.6
5,701,880 * 12/1997 Simonds ..... 124/88
5,718,213 * 2/1998 Gallops et al. ..... 124/25.6

* cited by examiner

*Primary Examiner*—John A. Ricci

(57) ABSTRACT

A compound archery bow having a cable guard comprising an attachment portion attached to the side of the riser and extending at an angle therefrom, the attachment portion having a support arm thereon, a pivotal swing arm connected to the support arm, and a cable retainer mounted on the pivotal swing arm.

6 Claims, 7 Drawing Sheets

ARCHERY BOW HAVING A SIDE MOUNTED SWING ARM CABLE GUARD

This invention is directed to an archery bow having a swing arm cable guard which is mounted to the side of the archery bow riser. The shape of the cable guard is such that the cable restraining means is located closer to the horizontal axis of the bow. Shims may be placed between the cable guard and the riser to vary the distance between cable guard and riser.

BACKGROUND OF THE INVENTION

Cable guards are utilized in compound archery bows when the cable and bowstring are too closely spaced laterally to permit the free passage of an arrow therebetween. The cable guard separates the cables and bowstring so that the arrow may pass therebetween. One such cable guard is disclosed in U.S. Pat. No. 5,718,213, "Swing Arm Cable Guard", wherein the applicant is a co-inventor. This patent discloses a cable guard including a support member and a swing arm pivotally connected thereto. A cable retaining means having two bores therein for retaining the cables is pivotally mounted on the swing arm. The angle between the support member and the swing arm is such that when the bow is drawn, the distance between the cables, which are contained in the cable retaining means, and the plane of the bowstring travel, is less than the distance between the cables and the plane of bowstring travel when the bow is at rest. Since the cables are closer to the plane of bowstring travel when the bow is drawn, the cables and bow limbs are less stressed when the bow is drawn. The cable guard retaining means may not be adjusted to change the distance between the cable guard retaining means and bowstring.

Another cable guard is disclosed in application Ser. No. 09/368,823, "Archery Bow Having an Incrementally Adjustable Cable Guard", assigned the owner of the present application. This application is directed to an incrementally adjustable cable guard retaining means whereby the distance between the cable guard and the bowstring may be as close as practicable while still permitting the free passage of the arrow being shot.

SUMMARY OF THE INVENTION

The present invention is directed to a swing arm cable guard which is rigidly mounted on the side of the archery bow riser. Side mounting of the cable guard reduces tension on the cable guard system to maintain the distance between the cable guard and riser, and vane clearance, when the bow is shot. The cable guard extends outwardly and upwardly from the side of the handle to the horizontal centerline of the bow. The position at which the cables are displaced is further from the limb tips than are, for example, the cables in other bows. By moving the cable displacement away from the limb tips, there is less limb torque and the limbs travel straighter during the draw cycle of the bow. Shims may be provided between the riser and the cable guard to vary the distance between the riser and the cable guard.

It is therefore an object of the present invention to rigidly mount a cable guard on the side of a riser so that the distance between the cable guard and riser is maintained when the bow is shot.

It is a further object of the present invention to provide a cable guard having cable restraining means that are close to the horizontal axis of the bow.

It is a still further object of the present invention to provide shims between the cable restraining means and the riser to permit the distance between the restraining means and riser to be varied.

Other objects and attendance advantages of this invention will be readily appreciated as the same become better understood by references to the following detailed description when considered in connection with the accompanying drawings in which like reference numerals designate like parts throughout the figures thereof.

DETAILED DESCRIPTION OF THE PREFERRED EMBODIMENT

Figure 1:
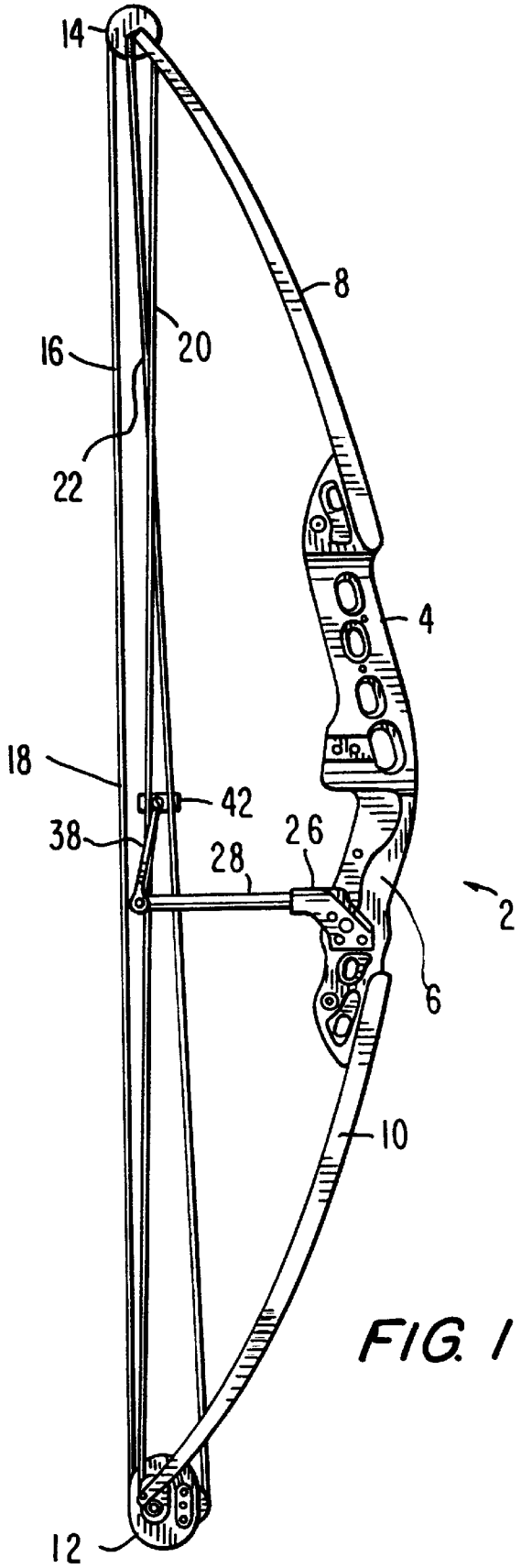
FIG. 1 is a side elevational view of an archery bow which includes the swing arm cable guard of the present invention mounted on the archery bow riser.

There is shown in FIG. 1 a compound archery bow 2, which includes a riser 4 having a handle portion 6. Riser 4 has flat sides and is connected at one end to an upper limb 8 and at the other end to a lower limb 10. A dual-feed cam 12 is mounted on an axial pin which extends through the bottom of lower limb 10. A concentric pulley wheel 14 is mounted on an axial pin which extends through the top of upper limb 8. While the illustrated bow is a dual-feed single-cam compound bow of the type disclosed in U.S. Pat. No. 5,368,006, it will be apparent that the cable guard of the present invention may be used with other types of compound bows.

A cable 16 has a medial portion trained around concentric pulley wheel 14 to form a main cable section or bowstring 18 and a secondary return cable 20. The ends of cable 16 pass around eccentric peripheral groove portions of the cam 12 and are connected to it, so that when the bow is shot bowstring 18 and cable 20 will be fed out from cam 12. An anchor cable 22 is anchored at one end to the axle which extends through the top of upper limb 8. The other end of anchor cable 22 passes around an eccentric peripheral groove portion of cam 12 and is connected to it. In this manner, anchor cable 22 forms a direct connection between the limbs 8 and 10.

Figure 6:
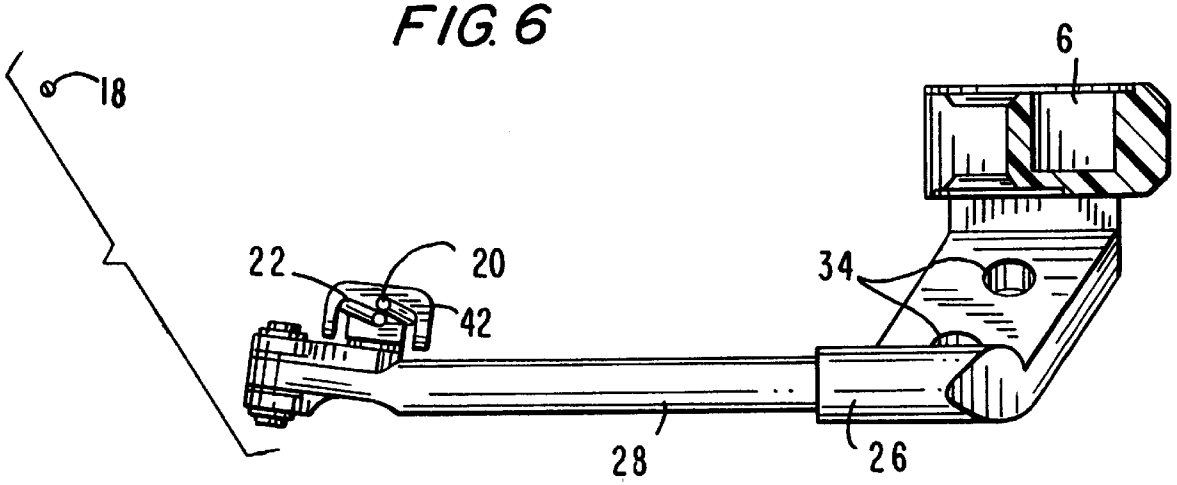
FIG. 6 is a top plan view of the riser and swing arm cable guard shown in FIG. 2 when the archery bow is in the brace position.
Figure 7:
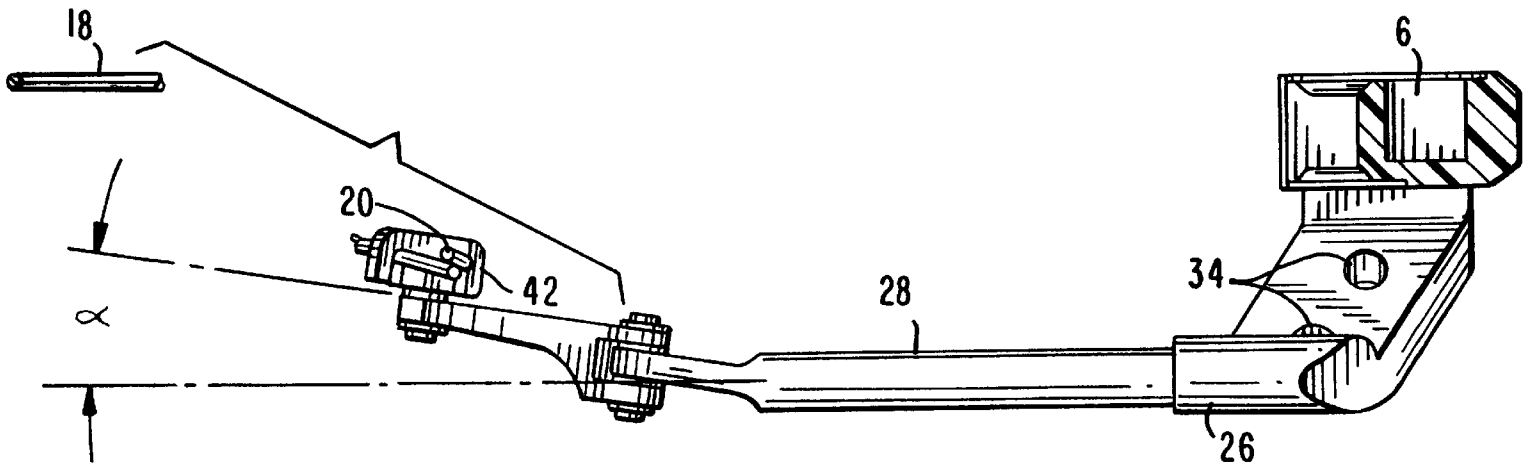
FIG. 7 is a top plan view of the riser and swing arm cable guard shown in FIG. 2 when the archery bow is in the drawn position.
Figure 8:
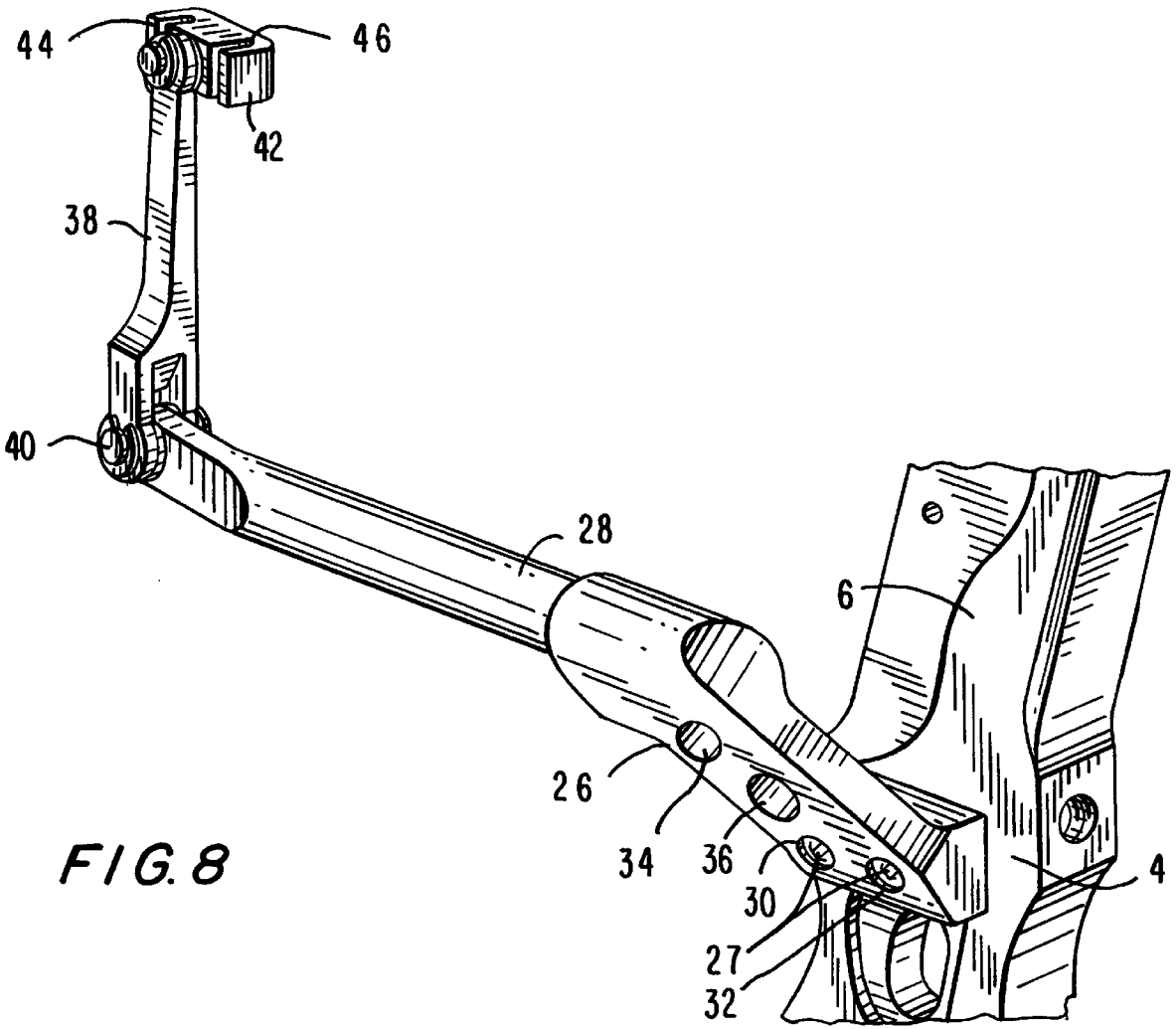
FIG. 8 is an exploded perspective view of the swing arm cable guard of the present invention.

Cable guard 24, as seen in FIG. 8, includes an attachment portion 26, which is connected to the side of riser 4 below the handle portion 6 and an integral support arm 28. Attachment portion 26 includes openings 30 and 32 which receive conventional socket head cap screws 27 for rigidly connecting attachment portion 26 to riser 4 beneath handle 6. Attachment portion 26 also includes openings 34 and 36 for the purpose of reducing the weight of cable guard 24. One end of a swing arm 38 is pivotally connected in an upward direction to support arm 28 at pivot end 40 and the other end of swing arm 38 has a cable retaining means 42 pivotally connected thereto. As seen in FIGS. 6 and 7, the end of support arm 28 connected to swing arm 38 is angled in the direction of the return cable 20 and anchor cable 22 to reduce the tension in the cables and limb torque when the bow is being drawn. Cable retaining means 42 includes openings 44 and 46 which retain return cable 20 and anchor cable 22.

Figure 2:
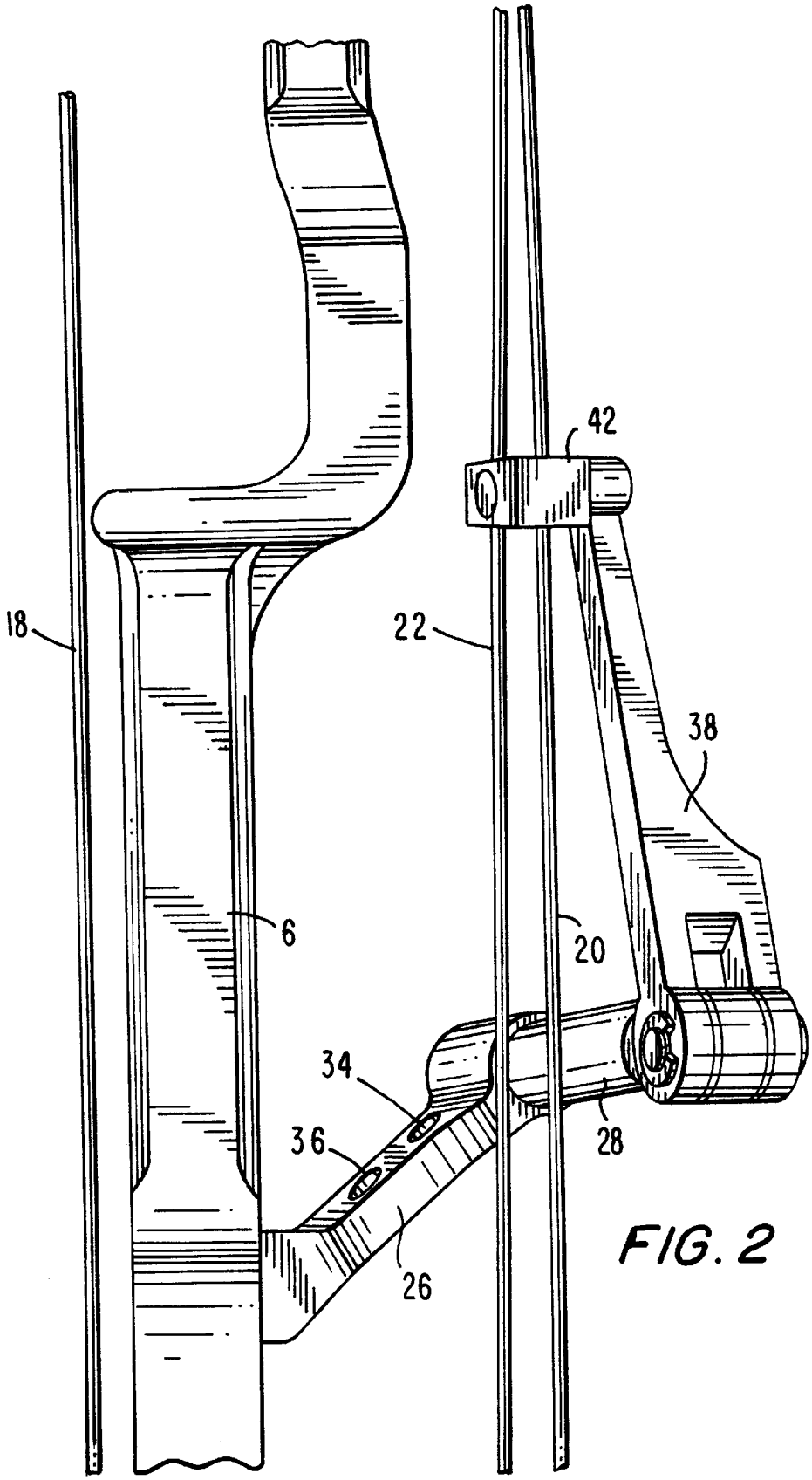
FIG. 2 is a rear elevational view of the riser having the swing arm cable guard of the present invention mounted thereon, as viewed by the archer.

As best seen in FIG. 2, attachment portion 26 of cable guard 24 extends outwardly and upwardly from riser 4 to the centerline of the bow. As a result of the upward position of attachment portion 26, and the upward direction of swing arm 38, cable retaining means 42 is also closer to the centerline of the bow or, stated otherwise, cable retaining means 42 is further from the tips of upper limb 8 and lower limb 10. Therefore, the position at which the return cable 20 and anchor cable 22 are displaced by the cable retaining means will be further from the tips of upper limb 8 and lower limb 10 and there will be less torque on the limbs when the arrow is shot. As a result, the limbs will travel straighter during the draw cycle of the bow and the shot will be more accurate.

Figure 3:
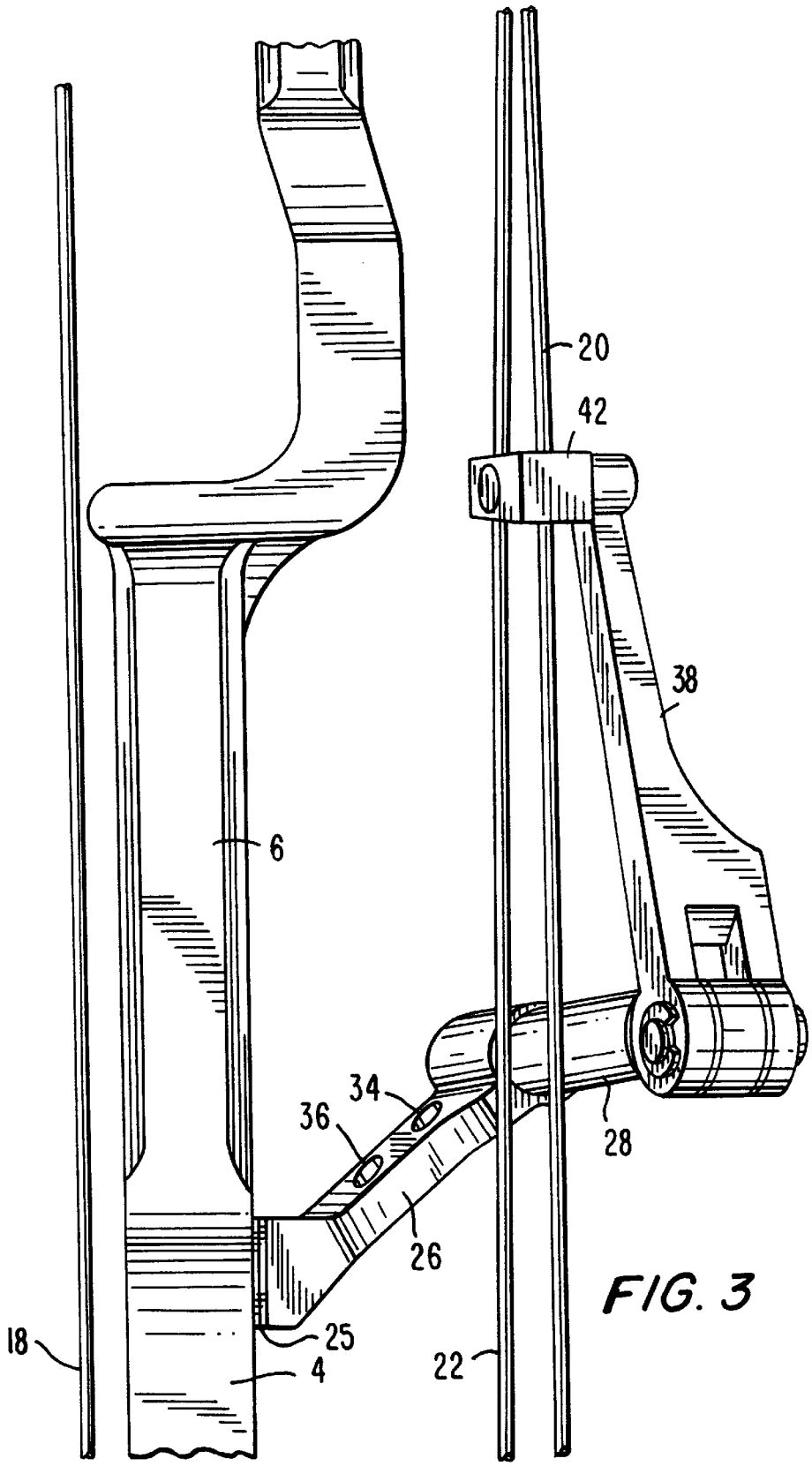
FIG. 3 is a rear elevational view of the riser having the swing arm cable guard of the present invention mounted thereon, as viewed by the archer, and including shims between the riser and the swing arm cable guard of the present invention to vary the distance between the cables and the bowstring.

As shown in FIG. 3, one or more shims 25 may be included between attachment portion 26 of cable guard 24 and the side of riser 4 to vary the distance between the cable restraining means 42, which is connected to attachment portion 26, and the side of riser 4 from, for example, x in FIG. 2 to x+y in FIG. 3. By varying the distance between the cable restraining means 42 and the side of riser 4, arrows having different size vanes may be more readily accommodated.

Figure 4:
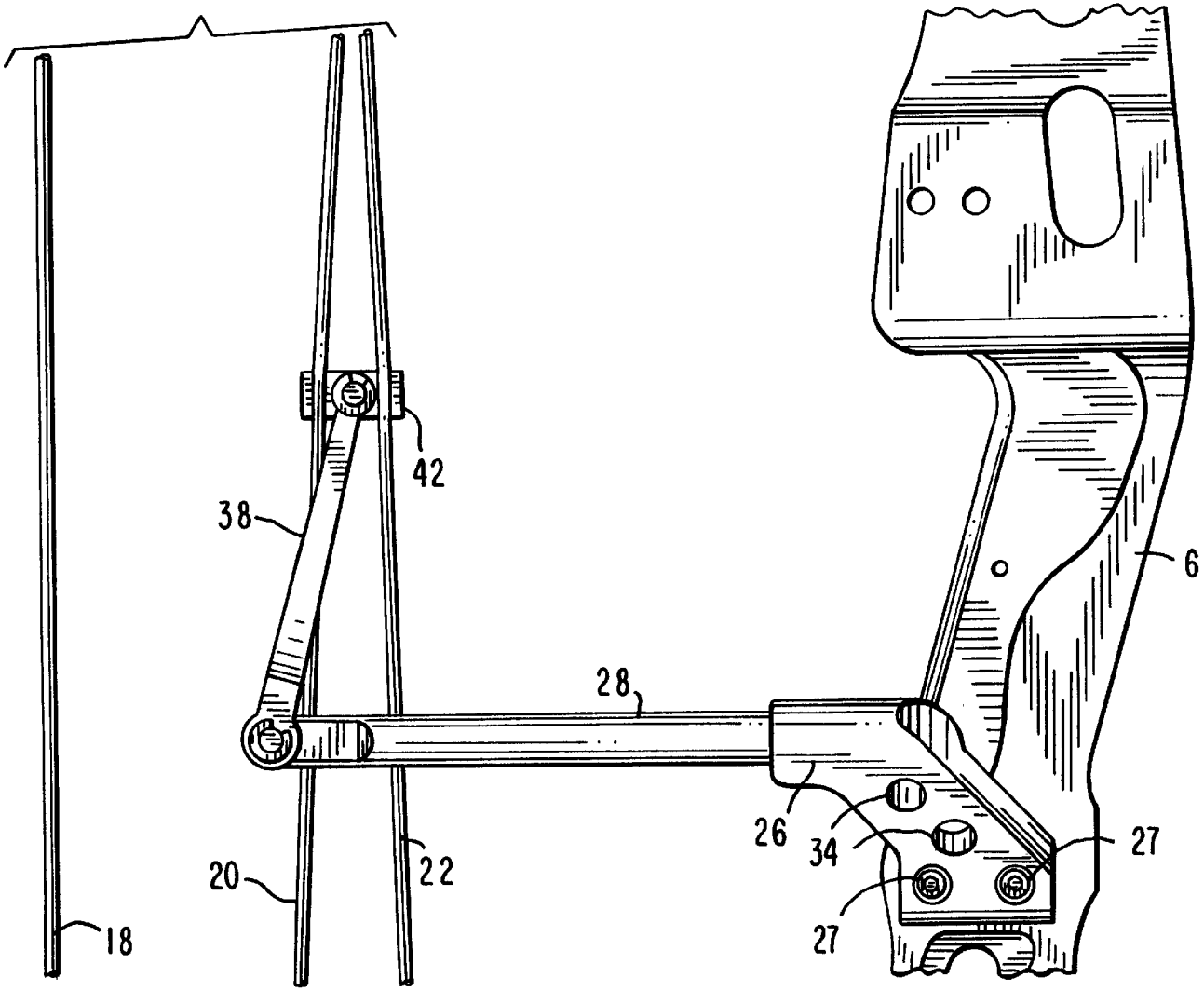
FIG. 4 is a left side elevational view of the riser and swing arm cable guard shown in FIG. 2 when the archery bow is in the brace position.
Figure 5:
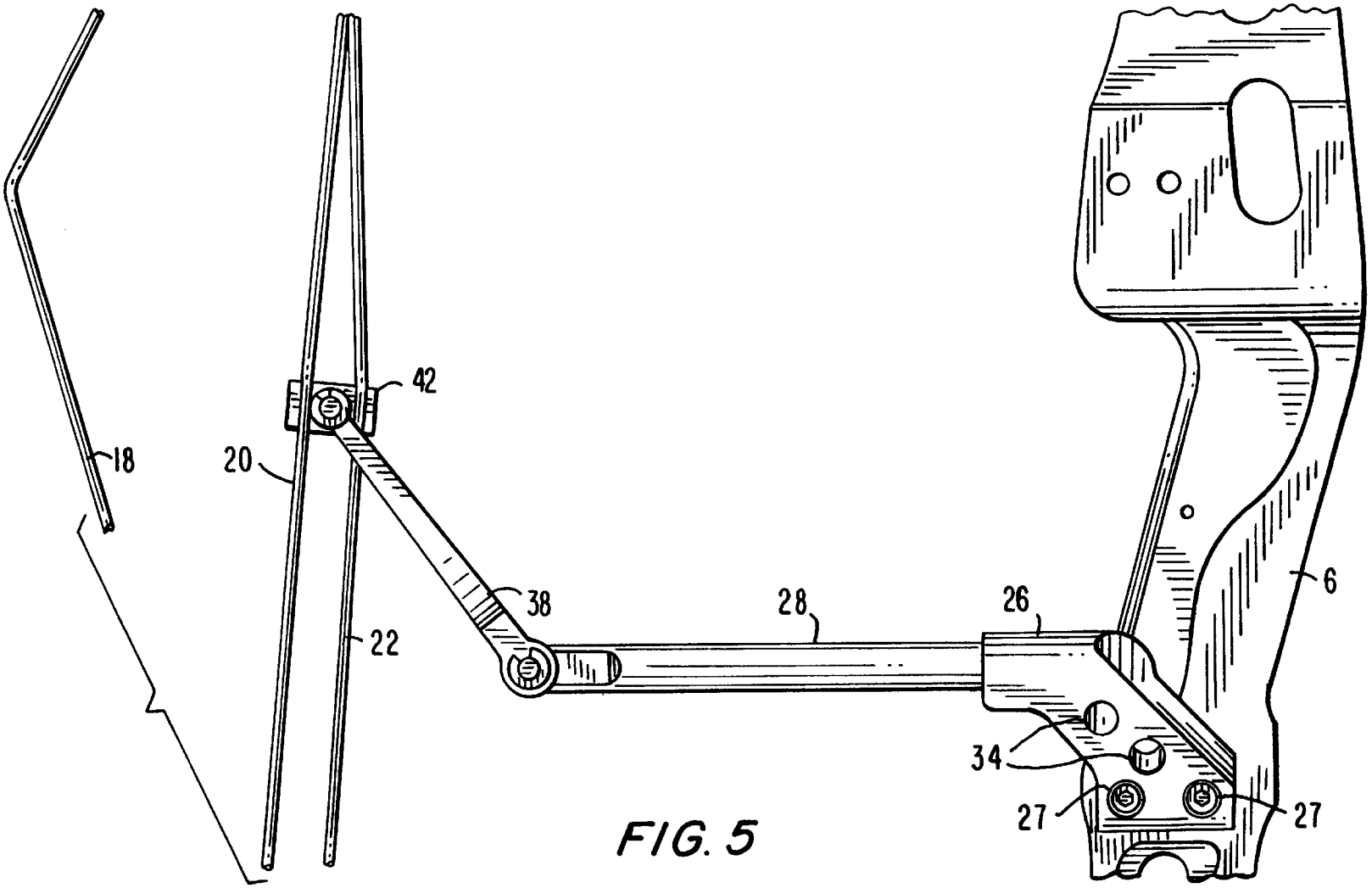
FIG. 5 is a left side elevational view of the riser and swing arm cable guard shown in FIG. 2 when the archery bow is in the drawn position.

The operation of cable guard 2 can be seen in FIGS. 4 and 6 wherein the bow is in the brace position and FIGS. 5 and 7 wherein the bow is in the drawn position. When bowstring 18 is drawn, cables 20 and 22 move in the direction of bowstring 18 swing arms 38, having cable retaining means 42 thereon, are caused to be pivoted counter-clockwise to the position shown in FIG. 5. After the shot, swing arm 38 pivots clockwise to return to the brace position shown in FIG. 4.

Having thus described the invention, it will be apparent to those skilled in the art that various modifications can be made within the scope of the invention. It is therefore understood that the present invention may be practiced otherwise than as specifically described.

I claim:

1. A compound archery bow comprising a cable guard, a bowstring, a riser having sides and a handle portion, a pair of bow limbs and a return cable, said cable guard comprising an attachment portion attached to the side of the riser, a support arm thereon, a pivotal swing arm connected to the support arm, cable retaining means mounted on the pivotal swing arm, and wherein the attachment portion extends upwardly and outwardly from the from the side of the riser.

2. A compound archery bow as recited in claim 1, and wherein the attachment portion is located beneath the handle portion of the riser.

3. A compound archery bow as recited in claim 1 and including one or more shims located between the riser and the cable guard for varying the distance between the riser and the cable guard.

4. A compound archery bow comprising a cable guard, a bowstring, a riser having sides and a handle portion, a pair of bow limbs and a return cable, said cable guard comprising an attachment portion attached to the side of the riser, a support arm thereon, a pivotable swing arm connected to the support arm, cable retaining means mounted on the pivotable swing arm, and wherein the attachment portion extends angularly from the side of the riser.

5. A compound archery bow as recited in claim 4, and wherein the attachment portion is located beneath the handle portion of the riser.

6. A compound archery bow as recited in claim 4 and including one or more shims located between the riser and cable guard for varying the distance between the riser and the cable guard.

* * * * *